US006994248B2

(12) United States Patent
Belway et al.

(10) Patent No.: US 6,994,248 B2
(45) Date of Patent: Feb. 7, 2006

(54) UNIVERSAL PILL COUNTING DEVICE

(75) Inventors: Ray Belway, Calgary (CA); Donald E. James, Calgary (CA)

(73) Assignee: Script Innovations Inc., Calgary (CA)

( * ) Notice: Subject to any disclaimer, the term of this patent is extended or adjusted under 35 U.S.C. 154(b) by 71 days.

(21) Appl. No.: 10/728,940

(22) Filed: Dec. 8, 2003

(65) Prior Publication Data

US 2004/0118753 A1 Jun. 24, 2004

Related U.S. Application Data

(60) Provisional application No. 60/431,732, filed on Dec. 9, 2002.

(51) Int. Cl.
*G06F 17/60* (2006.01)

(52) U.S. Cl. ..... 235/103; 235/385

(58) Field of Classification Search ..... 235/375, 235/103, 385, 381; 494/28, 29, 56, 221, 494/7, 13, 186; 221/221, 7, 13, 186; 209/551, 209/689, 691

See application file for complete search history.

(56) References Cited

U.S. PATENT DOCUMENTS

| | | | | |
|---|---|---|---|---|
| 3,386,618 A | | 6/1968 | Gilbert | |
| 3,900,718 A | * | 8/1975 | Seward | 702/128 |
| 4,013,192 A | * | 3/1977 | Pillon | 221/7 |
| 4,047,620 A | | 9/1977 | Deininger | |
| 4,396,828 A | * | 8/1983 | Dino et al. | 377/6 |
| 4,597,091 A | | 6/1986 | Blake | |
| 4,869,394 A | | 9/1989 | Hurst | |
| 5,338,284 A | * | 8/1994 | Knelson | 494/28 |
| 5,597,995 A | * | 1/1997 | Williams et al. | 235/375 |
| 5,992,742 A | * | 11/1999 | Sullivan et al. | 235/462.01 |
| 6,036,129 A | * | 3/2000 | Ambrose | 241/207 |
| 6,053,302 A | | 4/2000 | Leu et al. | |
| 6,196,426 B1 | | 3/2001 | White | |
| 6,253,953 B1 | | 7/2001 | Ishizuka | |
| 6,377,648 B1 | | 4/2002 | Culbert | |
| 6,561,377 B1 | * | 5/2003 | Pearson et al. | 221/7 |
| 6,776,341 B1 | * | 8/2004 | Sullivan et al. | 235/462.01 |
| 2003/0111484 A1 | * | 6/2003 | Pearson et al. | 221/211 |
| 2004/0118753 A1 | * | 6/2004 | Belway et al. | 209/551 |

* cited by examiner

*Primary Examiner*—Thien M. Le
(74) *Attorney, Agent, or Firm*—Sean W Goodwin; Linda M Thompson

(57) ABSTRACT

A bench-top pill counter accurately and automatically counts a wide variety of shapes and sizes of pharmaceutical pills and capsules, having a variety of coatings. A rotating bowl, periodically shaken during rotation, is combined with a fixed, flared spiral guide ramp causing pills to distribute individually on an annular ledge in the bowl. The pills are dispensed from the bowl onto a sloped slide and counted at the bottom of the slide by an optical counter. The micro-computer determines an optimum speed and shake algorithm for the bowl, based on the characteristics such as the size and shape of the pills, so that the pills distribute individually and only one pill at a time passes the counter.

36 Claims, 8 Drawing Sheets

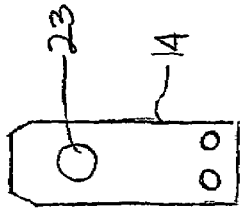
Fig. 7
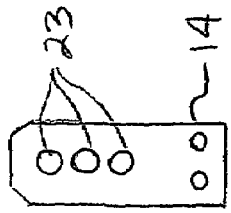
Fig. 8
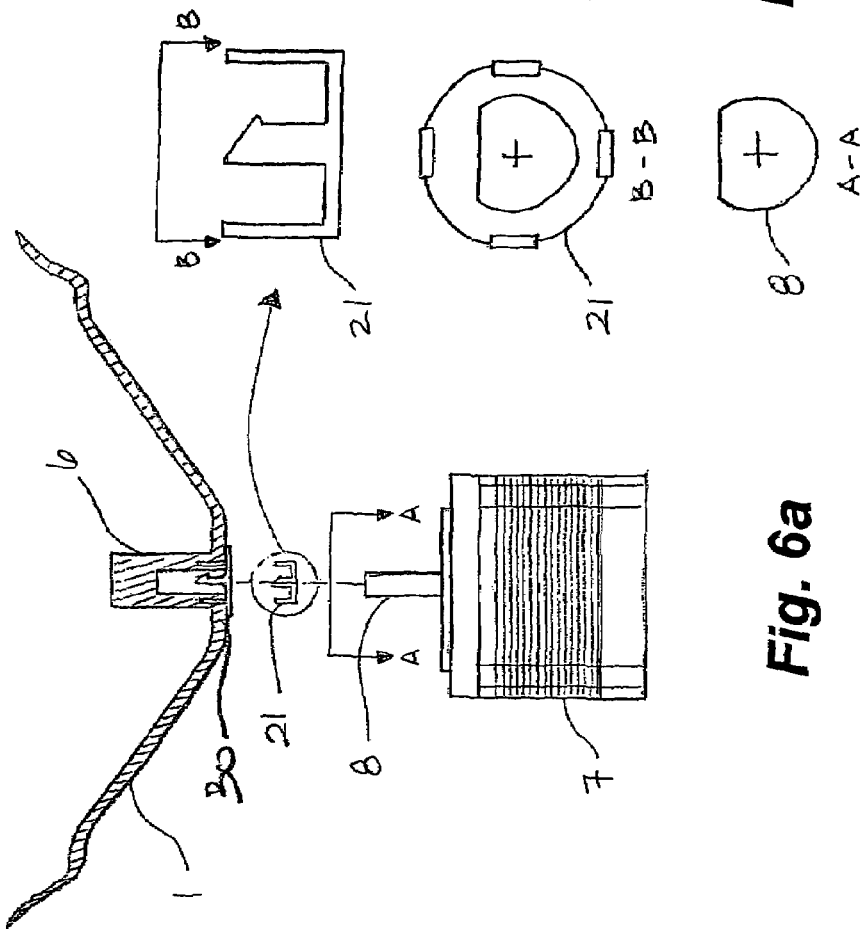
Fig. 6b
Fig. 6c
Fig. 6d
Fig. 6a

UNIVERSAL PILL COUNTING DEVICE

CROSS REFERENCE TO RELATED APPLICATIONS

This application is a related to and claims the benefit of co-pending U.S. Provisional application Ser. No. 60/431,732, filed Dec. 9, 2002, the entirety of each of which is incorporated herein by reference.

FIELD OF THE INVENTION

The present invention relates to apparatus and method for counting objects, such as individual pharmaceuticals, including pills, tablets, capsules and the like, and more particularly to counting a wide variety of shapes and sizes of pharmaceuticals.

BACKGROUND OF THE INVENTION

It is well known in the pharmaceutical industry to count a desired number of pills or capsules or the like for dispensing to patients in hospitals or pharmacies. Typically, large institutions utilize large and expensive robotic dispensers which store a number of different pharmaceuticals on board and utilize computerized methods of determining the number of units dispensed. One such method is to store a size and weight for each pharmaceutical in the onboard computer so that a desired number of units can be dispensed based on a differential weight determination.

Small pharmacies do not typically have access to large robotic units and very often, pharmacists must count pills manually using a tray, which is very time consuming and prone to error. Repeat counting may be instituted to ensure accuracy, however, this adds to the dispensing costs.

Some attempts have been made to provide small portable dispensing units suitable for smaller pharmacies and the like, where a vast number of different types of pharmaceuticals may be dispensed, having unique sizes, weights, shapes and coatings.

U.S. Pat. No. 3,386,618 to Gilbert teaches a rotating bowl having an intermediate, annular, flat and horizontal surface located between the top and bottom of the bowl. A stationary spiral guide ramp comprising an inner spiral and an outer spiral is positioned inside the bowl such that which when the bowl is made to rotate below the stationary ramp, small objects, such as pills, placed in the bowl are caused to move upward inside the bowl and separate into single file. A series of ribs on the inner surface of the bowl aids in causing the pills to move upwards along the wall of the bowl and along the spiral ramps. An annular element is positioned about the top edge of the bowl and is rotated at a speed faster than that of the bowl, acting as a centrifuge to position the pills at an outer and slightly lower edge of the annular element, where they fall through an outlet and are counted by some counting means.

The unit of Gilbert relies on the weight of the pills to avoid stacked pills being carried up the second inclined surface to the top of bowl and ultimately counted as a single pill. Applicant has found that given the diversity of pill shapes and sizes, as well as the types of coatings used in some pills, that one cannot rely on weight alone to separate stacked pills. Although many types of pills naturally line up in single file on the ledge, flat pills pile on top of one another and small pills sit side by side. Thus, two pills appear as one to the optical sensor.

It is further taught by Pillon in U.S. Pat. No. 4,013,192, that the counting aspect of the apparatus of Gilbert can be improved by the inclusion of an exposed slide ramp leading to an optical-based counter employing a photoelectric sensor. A gate located at the bottom of the slide acts to direct the counted pills into a prescription bottle. After the pre-programmed number of pills is dispensed, the gate is pivoted and the remainder of the pills is directed to a stock pill bottle. The apparatus of Pillon is capable of dispensing and counting only a small number of pill types and is not adaptable to handle the enormous variety of shapes and sizes found within pharmaceuticals today.

It is clear that there is a need for a reliable, accurate device for counting a wide variety of pharmaceuticals regardless of size, shape, weight or surface coating and particularly that is suitable for small pharmacies to reduce the cost of prescription dispensing.

SUMMARY OF THE INVENTION

Problems encountered in the prior art relating to the effects of shape, size, weight and coating of pharmaceuticals to be counted are addressed in embodiments of the present invention by causing the bowl to be rotated at different speeds and shaken for different durations and at different frequencies, based on the size and shape of the pills and which is assisted through modification of a stationary spiral guide ramp which guides pills from the bowl. Preferably, combinations of a plurality of rotational speeds and frequencies of shaking are employed, along with the spiral guide ramp having a flare on at least a portion of a lower edge and a rotating bowl, to assist in distributing the pills individually so that individual pills can be counted. Alterations in the rotational speed and/or the frequency of shaking are made, either manually or as a result of selection of a stored algorithm, known to be successful for a particular pill type. Alternatively, a plurality of combinations are attempted until one is found to be successful for a particular pill type.

In an embodiment of the invention, a plurality of algorithms are pre-programmed into the pill counting device and are selected manually by a user or automatically by the device based on characteristics such as a determination of the size of the pill being counted. The algorithms can be selected to cover a wide variety of pharmaceuticals and can be adapted or added as new pharmaceutical types become available.

Accordingly, in a broad aspect of the invention a method is provided for counting objects which is adapted for use with a spiral guide ramp held stationary in a bowl, the method comprising: placing the objects in a bottom of the bowl, rotating the bowl so as to cause the objects to be guided along the spiral guide ramp on a first annular inclined surface portion from a bottom of the bowl to an annular, substantially flat ledge and for guiding the objects from the ledge to the top of the bowl; and periodically altering an angular velocity of the rotation of the bowl so as to distribute objects on the ledge individually therealong and traverse a gap in the ramp adjacent the ledge and be guided to the top of the bowl or to fall through the gap to return to the bottom of the bowl.

The method can be implemented in an apparatus embodiment comprising: a bowl adapted for holding a plurality of the objects therein and rotatable about an axis in housing, the bowl further comprising, a first annular inclined surface portion adjacent a bottom of the bowl, a second annular inclined surface portion adjacent a top of the bowl, and an annular, substantially flat ledge intermediate and interconnecting the first and second inclined surfaces; a spiral guide ramp held stationary within the rotating bowl for guiding the objects from the bottom of the bowl to the ledge and from the ledge to the top of the bowl, the ramp forming a gap adjacent the ledge; a controller for periodically altering an angular velocity of the rotation of the bowl so as to cause the objects on the ledge to either distribute individually therealong and traverse the gap to be guided to the top of the bowl or to fall through the gap to return to the bottom of the bowl; a slide for guiding the objects individually from the top of the bowl to one of either a first collecting means or a second collecting means; a counter for counting individual objects guided to the first collecting means; and a gate at a first position for guiding individual objects into the first collecting means and when a predetermined number of objects have been collected in the first collecting means the gate being actuable to a second position for guiding individual objects into the second collecting means.

Preferably, a flare extends from at least a portion of a lower edge of the spiral guide ramp to assist in guiding the objects therealong.

As an illustration of the shaking embodiment, a selected speed of rotation and shaking causes multiples of large flat pills to be knocked off of each other and small clustered pills to become distributed individually as they are ramped up out of the bowl onto the annular ledge and along the outer spiral guide once lined up on the ledge. The particular algorithm for shaking can be selected based on particular characteristics of the pills including their size which can be detected by measuring the time the pills take to pass an optical sensor at the bottom of the slide. Small smooth ball-shaped pills typically spin against the stationary spiral ramp and do not exit the bowl. This is addressed by varying the speed of the bowl rotation and changing the frequency and duration of the shaking to maintain a more or less a constant frequency of pills exiting the bowl. The frequency of exit can be determined by the frequency of the pills crossing the optical sensor. Further, it has been observed that rubbery pills, typically a result of the coating, can bounce as they progress down the slide ramp and may jump over a single optical sensor beam. This problem is addressed by arranging a plurality of sensors to form a vertical array in a fence like manner to detect pills that may have bounced above the lower sensor beam. The optical sensor comprises a vertical stack of sensor in order to detect pill height. As pills tend to travel at similar speeds, the time is related to the pill's longest dimension of its shape. The number of the vertical stacked plurality of optical beams that are cut as the pill passes through is an indication of the height or shape of the pill.

BRIEF DESCRIPTION OF THE DRAWINGS

FIGS. 6*a*–6*d* are schematics illustrating the relationship between the rotating bowl and the motor, more particularly, FIG. 6*a* is a side view illustrating the relationship between the rotating bowl, the shaft, the motor, the motor shaft and an optional external reinforcement;

FIG. 6*b* is an enlarged side view of the external reinforcement,

FIG. 6*c* is a plan view of the external reinforcement along lines B—B, and

FIG. 6*d* is a sectional view of the motor shaft along section lines A—A;

FIG. 7 is a schematic illustrating a single photo-emitter sensor; and

FIG. 8 is a schematic illustrating a sensor having a vertically stacked plurality of photo-emitter sensors.

DESCRIPTION OF THE PREFERRED EMBODIMENT

There is herein described, apparatus and method for accurately and reproducibly counting a wide variety of small discrete objects and particularly, a wide variety of pharmaceuticals available as pills, tablets, capsules and the like which will herein be referred to as pills. Aspects of the bowl, spiral guide ramp and general operation are described in U.S. Pat. No. 3,386,618 to Gilbert and are incorporated herein by reference. Further, aspects of the slide and gate are described in U.S. Pat. No. 4,013,192 to Pillon and are incorporated herein by reference.

Figure 1A:
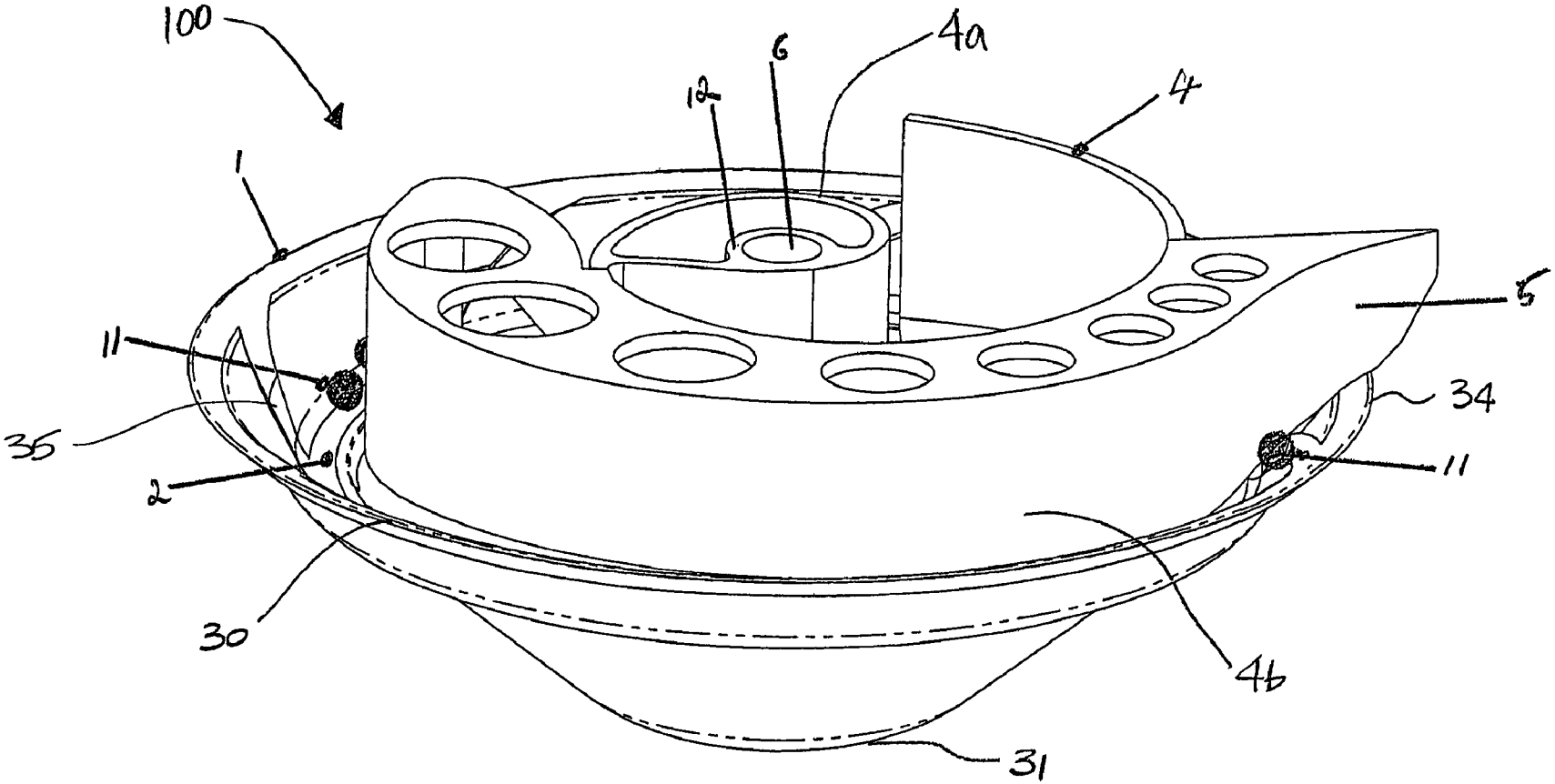
FIG. 1*a* is an perspective view of a bowl and a stationary spiral guide ramp of a pill counter of the present invention showing the relationship between a rotating bowl and a stationary spiral guide ramp.
Figure 1B:
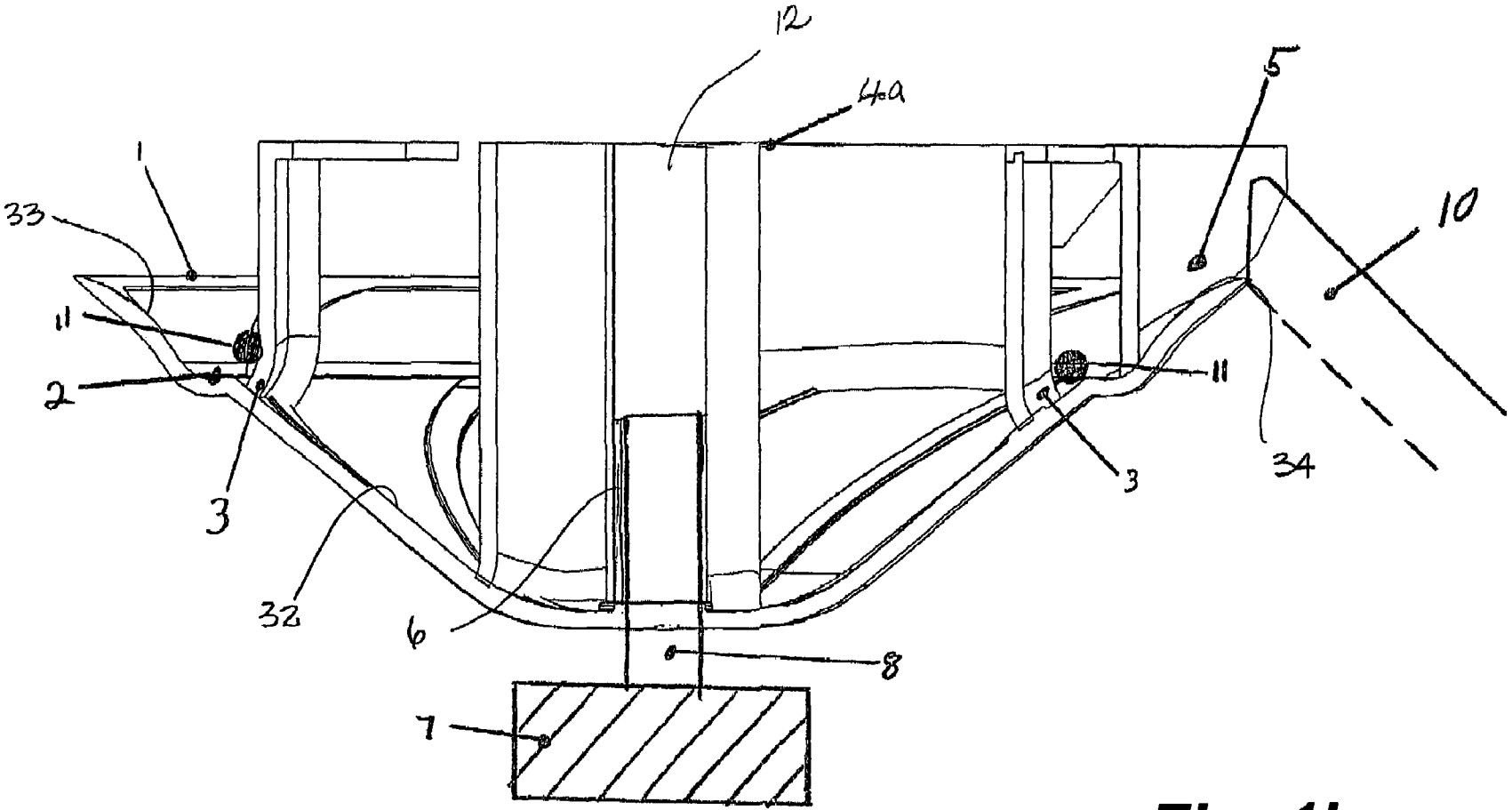
FIG. 1*b* is a partial sectioned elevation view according to FIG. 1 showing the bowl, the stationary spiral guide ramp and a motor.
Figure 1C:
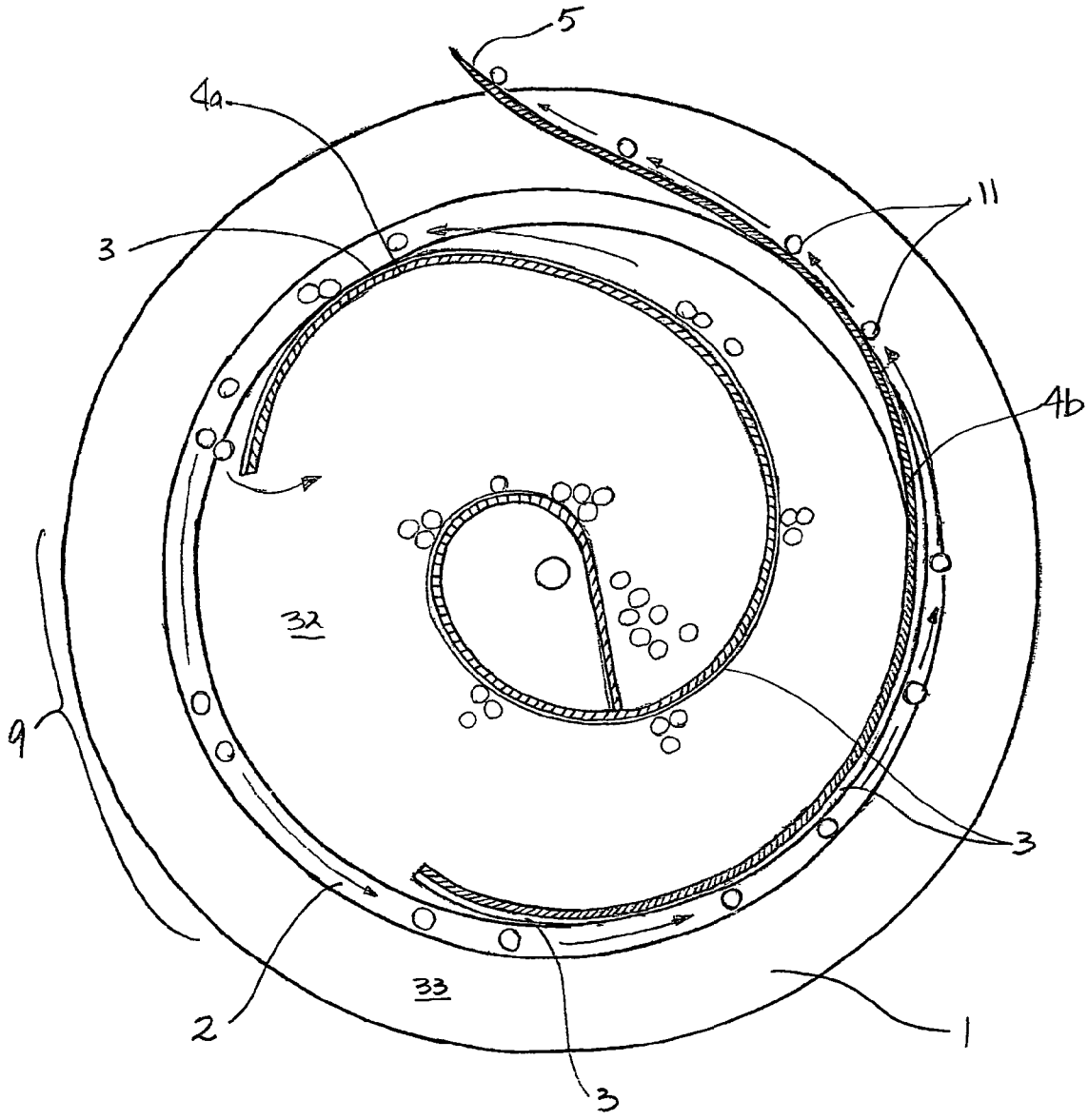
FIG. 1*c* is a plan view according to FIG. 1*a* illustrating the relationship between an inner and outer spiral of the stationary spiral guide ramp, pills to be counted and the bowl.

Having reference to FIGS. 1*a*–1*c*, a rotating bowl 1 and a stationary spiral guide ramp 4 for a pill counter 100 are shown. The stationary spiral guide ramp 4 further comprises an inner spiral 4*a* and an outer spiral 4*b*. An annular, substantially flat and horizontally extending surface or ledge 2 is located intermediate a top 30 and a bottom 31 of the bowl 1, and is preferably approximately ⅓ of the way down from the top 30 of the bowl 1. A flare 3 is formed along a bottom of at least a portion of the inner and outer spirals 4*a*, 4*b*. Co-operation of the flare 3 with the ledge 2 results in the distribution of a plurality of pills 11 onto the ledge, the pills having been directed from the bottom 31 of the bowl 1 by the spiral guide ramp 4.

The ramp 4 directs the pills 11 to initially and upwardly traverse a first inclined surface 32 of the bowl 1 along a path defined by the inner spiral 4*a*. As the pills reach the ledge 2, the arrangement of a pill or pills 11 are either distributed individually thereon or those which are not secure thereon are re-directed back into the bottom 31 of the bowl 1. The pills 11 on the ledge 2 are further conveyed therealong and then up a second inclined surface 33 of the bowl 1 above the ledge 2 by the outer spiral 4*b*. The pills 11 are caused to exit the bowl at an end 5 of the outer spiral 4*b*. The end 5 extends beyond an upper edge 34 of the bowl 1 and directs each pill 11 to a slide 10.

Preferably the inclined surfaces 32,33 of the bowl 1 are formed having a plurality of webs 35 formed thereon to assist in moving the pills 11 up the inclined surfaces 32,33 as the bowl 1 is rotated.

Figure 2:
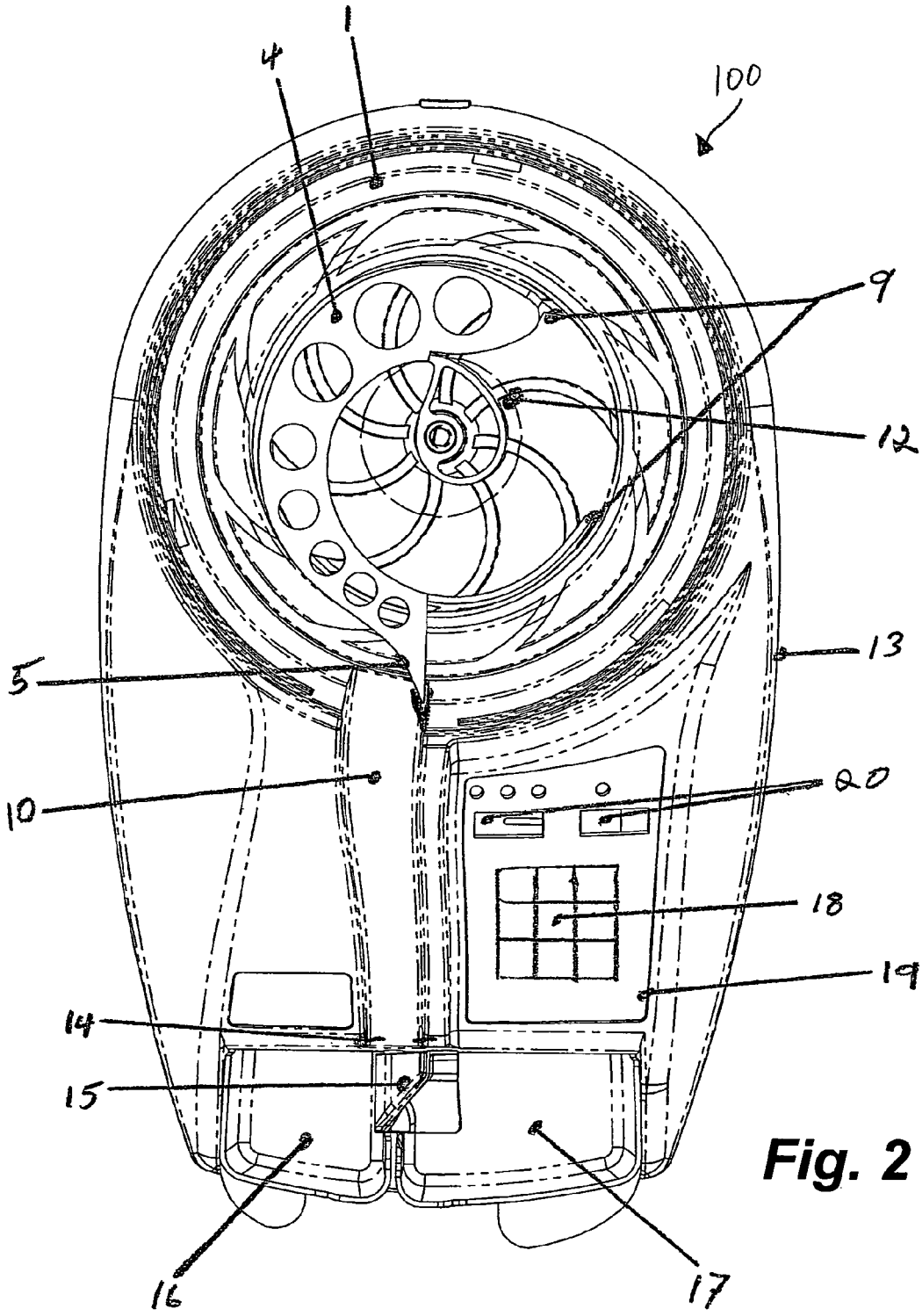
FIG. 2 is top plan view according to FIG. 1*a* illustrating the configuration of the relationship between the bowl, stationary spiral guide ramp, slide, optical sensors, gate wedge and catch basins within a housing.

Having reference to FIGS. 1*c* and 2, a gap 9 formed between the inner spiral 4*a* and the outer spiral 4*b*. Pills 11, which are not distributed sequentially and individually on the ledge 2 or which are stacked on top of one another, are caused to return to the bottom 31 of the bowl 1 through the gap 9. Preferably, the gap 9 is located approximately one turn or 360 degrees up from the start of the spiral guide ramp 4 and is approximately ¼ turn or 90 degrees long. This gap allows excess pills 11 to return down the first inclined surface 32 to the center of the spiral guide ramp 4 and thus to the bottom 31 of the bowl 1. Only individual pills 11 securely lodged on the ledge 2 remain to be carried by the outer spiral 4*b* to exit the bowl 1.

The end 5 of the outer spiral 4*b*, which extends beyond the upper edge 34 of the top 30 of bowl 1, is retained against an upper edge of a housing 13 in which the components are fit, to prevent co-rotation of the stationary spiral guide ramp 4 with the bowl 1. The end 5 of the outer spiral 4*b* directs the pills 11 to the slide 10. The slide 10 is angled sufficiently to cause pills 11 to fall by gravity and pass a counter comprising one or more optical sensors 14 positioned at a bottom end of the slide 10. Gravity pulls the pills 11 at more or less a constant speed down the slide 10. At the bottom of the slide 10, the pills 11 pass through a gate, comprising a wedge-shaped paddle 15. The wedge 15 is movable, preferably approximately 90 degrees, between a first position which directs the pills 11 to a first catch basin 16 and a second position which blocks passage to the first catch basin 16 and diverts the pills 11 to a second catch basin 17.

To minimize counting errors, pills 11 should fall one at a time past the sensors 14. To assist in directing and distributing the pills 11 individually on the ledge 2, the bowl 1 is first rotated at some initial or predetermined speed, the speed being selected based on characteristics such as the shape, size and coating of each type of pills 11 and other empirical data. Further, an angular velocity of the bowl 1 is periodically altered to adjust or dislodge multiples of pills 11 or otherwise unstable arrangements of pills 11 such as those which are resting on the edge of the ledge 2, or those which may have a tendency to lie on top of one another or side-by-side on the ledge 2. Alteration in angular velocity or shaking is performed by rapid alteration of variables of the rotation of the bowl 1 such as to stop or reverse the direction of rotation of the bowl 1. A typical scenario is to first rotate the bowl 1 in a first pill-collecting direction, to suddenly reverse the direction for a portion of a rotation, and then to return to rotation in the first direction. A preset number of rotations can be performed before the shaking is repeated. The number and speed of such rotations between shaking events is predetermined specifically for the individual pill type based on empirical data.

The shaking, whatever the scenario, facilitates removal of undesirable arrangements of pills 11 at the gap 9 which may be adjacent another and not securely on the ledge 2.

With reference to FIGS. 6*a*–6*d*, shaking is preferably achieved through manipulation by the means used to rotate the bowl 1, such as a drove or motor 7. A hub 6 is formed at a center of the bottom 30 of the bowl 1 into which a shaft 8 of the motor 7 is inserted. The shaft 8 extends from the motor 7 for rotating the bowl 1. As shown in FIG. 1, a bore 12 at a center of the inner spiral 4*a* of the stationary spiral guide ramp 4 is positioned over the hub 6 to position the stationary spiral guide ramp 4 relative to the bowl 1. The nested hub 6 and bore 12 are arranged to fit loosely so that the bowl 1 and fixed ramp 4 may be easily removed for cleaning. Preferably, for some materials for manufacture of the bowl 1, the motor shaft 8 is non-circular or D-shaped to co-rotationally secure the bowl 1 despite rapid reversal of the bowl 1 during a shaking sequence. Such a bowl 1, typically made of plastic such as ABS may be provided with a reinforcement 21 about the base of hub 6 to resist wear and minimize lash. Other materials such as urethane may not require either a reinforcement or a non-circular shaft 8 to retain drivable connection therebetween. Preferably, a suitable motor 7 for effecting the shaking rotation behavior is a stepping motor such as Model SST58D2810 available from Shinano Kenshi Co. Ltd. of Japan.

Figure 3:
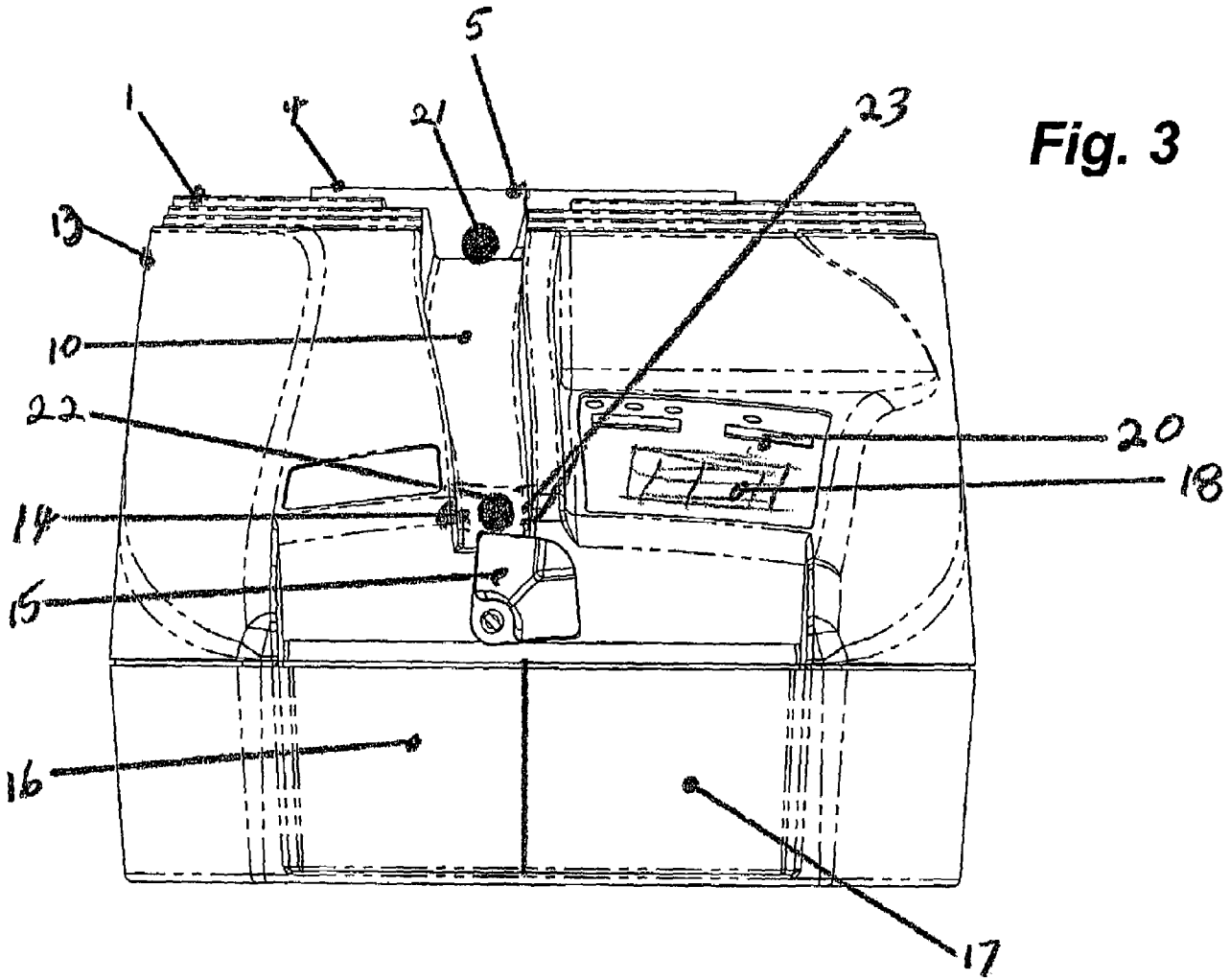
FIG. 3 is a front view according to FIG. 2.

With reference to FIGS. 2 and 3, the pill counting device 100 further comprises a display 20 and a key pad 18 on a front face of the housing 13 and a controller or micro-computer 19 located below and inside the housing 13. Preferably, the housing 13 has a small footprint and is designed as a bench-top pill counting device 100.

Having reference to FIGS. 3, 7 and 8 and in a preferred embodiment of the invention, the sensor 14 located at the bottom of the slide 10 comprises a single sensor 14 (FIG. 7) or a plurality of vertically-stacked sensors 14 (FIG. 8) such as photo-emitters, three in this embodiment, each emitting a light beam 23 which is sensed on an opposing side of the slide 10 by a corresponding detector.

Applicant has observed that some pills 11, typically as a result of the pill's coating, can bounce during passage down the slide 10 and may jump over a single optical sensor beam 23 resulting in the errant pills 11 not being counted. The plurality of sensors 14 stacked to form a vertical array in a fence like manner or height-discriminating sensor, detects pills 11 that may have otherwise bounced above a lower sensor beam 23. Further, the number of optical beams 23 interrupted in the height-discriminating optical sensor 14 can be monitored as being indicative of pill height as a pill 11 passes therethrough.

The micro-computer 19 is capable of utilizing information about characteristics affecting the collection of the individual pharmaceuticals provided by the sensors 14 as a group, or each of the sensors 14, to determine how the bowl 1 is to be driven. Pills 11 falling down the slide tend to travel at similar speeds thus the time required to pass the sensor 14 is related to the pill's longest dimension. The sensors 14 detect the interruption of the individual light beams 23 as the pill 22 passes, the time of passage and the number of beams 23 being interrupted are used to calculate a pill height and to determine how the bowl is to be driven. Driving of the bowl 1 includes at least a rotational speed rpm and a shaking frequency and is based upon the frequency that pills 11 pass the sensors 14 and individual pill 22 height. The rotational speed and shaking frequency may be selected from a number of pre-programmed algorithms stored within the micro-computer 19 or alternatively, may be programmed manually therein.

Having reference again to FIG. 3, the wedge-shaped paddle 15 of the gate is shown in the first position so that the pill 22 will fall into the first catch basin 16 after it is counted. As soon as the selected number of pills 11, entered by the user on the keypad 18, have been collected, the wedge 15 is moved to the second position to block passage to the first catch basin 16 and remaining surplus pills 11 are recovered in the second catch basin 17.

Figure 4A:
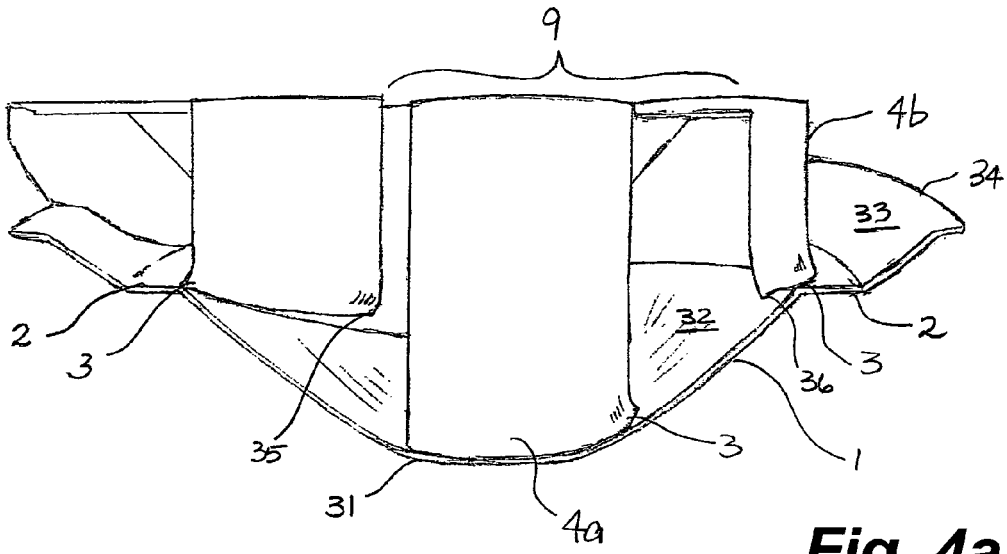
FIG. 4*a* is a cross-sectional view of the bowl with the stationary spiral guide ramp installed and shown at a gap between the inside spiral and the outside spiral, illustrating the relationship between a flat annular ledge and a flare at a bottom of the outer spiral and the bowl and a flare at the bottom of the inner spiral.
Figure 4B:
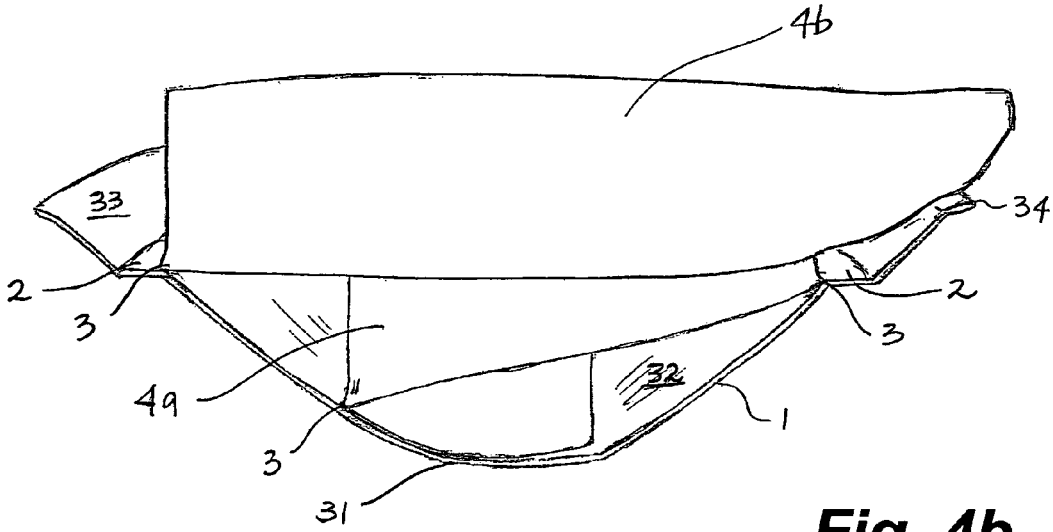
FIG. 4*b* is a side cross-sectional view of the bowl with the stationary spiral guide ramp installed, illustrating the relationship between the flares at the bottom of the inner and outer spirals with the bowl and annular ledge and between an exit end of the outer spiral and an upper edge of the bowl.

FIGS. 4*a* and 4*b* illustrate the relationship between the flares 3 at the bottom of the inner and outer spirals 4*a*, 4*b* and the bowl 1 and ledge 2. Particularly, the flares 3 act like a scoop to encourage the pills 11 to move up the first and second inclined surfaces 32,33 where the flares 3 contact the bowl 1 and further act to assist in individually distributing the pills 11 on the ledge 2 on either side of the gap 9. More particularly the flares 3 are directed downwards into the bowl 1 at the end 35 of the inner spiral 4*a* at the gap 9 and at the beginning 36 of the outer spiral 4*b* after the gap 9. At the end 35 of the inner spiral 4*a*, the downward depending flare 3 assists in releasing unstable pills 11 from the ledge 2; those that are not distributed individually. After the gap, at the beginning 36 of the outer spiral 4*b*, the downward depending flare 3 acts like a hook to encourage the retention of larger pills on the ledge 2 and to ensure that pills 11 that are now distributed individually thereon and may have moved towards the edge of the ledge 2, are retained for passage around the outer spiral 4*b* and to the slide 10 for counting.

Figure 5:
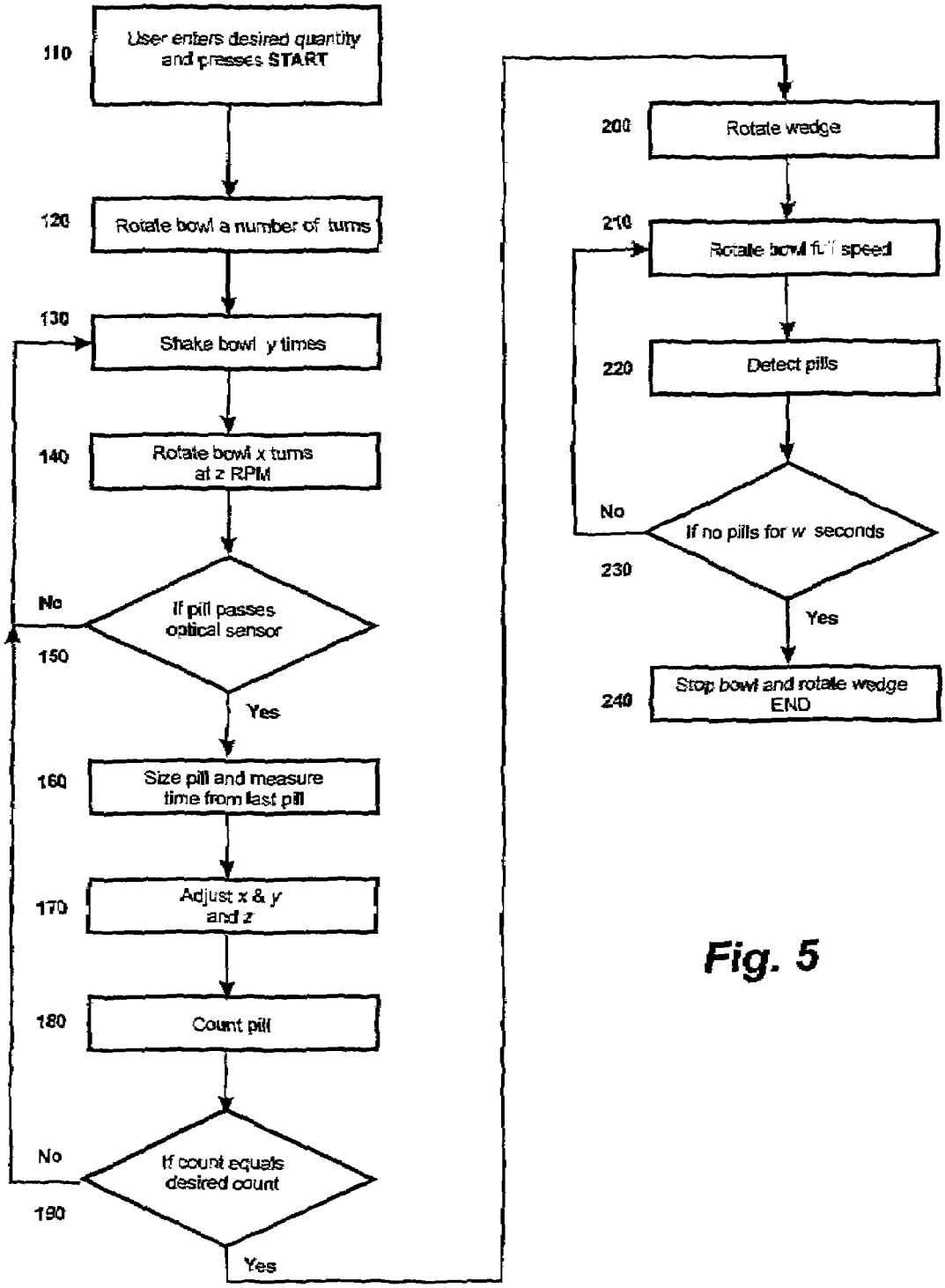
FIG. 5 shows a basic simplified flow diagram of the operations of a pill counter.

Having reference to FIG. 5, a simplified flow chart illustrates an embodiment of a method of counting pills using the apparatus herein described. A user activates the pill counter 100 by entering the desired number of pills 22 using the keypad 18 and pressing the "START" key 110 on the keypad 18. The bowl 1 is rotated in the first direction, typically counterclockwise, at a preset and rapid rate for a predetermined number of rotations 120. Periodically, the bowl 1 is caused to shake a predetermined number of times 130, by momentarily halting the rotation in the first direction, reversing the rotation for a partial rotation and then returning the bowl to the position it was in prior to beginning the shaking sequence. The bowl 1 continues to be rotated for a predetermined number of rotations at a predetermined speed 140. Rotation and shaking are continued 130, 140 as long as a pill 11 is not detected 150 by the optical sensors 14.

When the optical sensors 14 detect a pill 150, the micro-computer 19 determines the collection characteristics, being approximately a size and a shape of the pill 22 by determining the rate of presentation of the pills 11 past the sensor 14 and detecting how many of the optical sensor 14 beams were cut 160. Using the collection characteristic information determined 160, the micro-computer 19, if required, adjusts one or all of a speed of rotation z, number of turns y, and/or a number of shakes x 170, by selecting the most appropriate algorithm for that size of pill from a plurality of preprogrammed algorithms stored therein.

As each pill 22 passes the sensor 14 and is detected, the micro-computer 19 increments the pill counter 180. The micro-computer continually monitors the incremented counter to determine whether the number equals the desired quantity 190. If the desired quantity has not been reached, the sequence, as described, is continued 130. If the count is equal to the desired preset number, the wedge-shaped paddle 15 is rotated from the first position to the second position 200, such that the remainder of the pills 11 is directed to the second catch basing 17. The bowl 1 is then rotated counterclockwise at full speed 210, to remove any remaining pills from the bowl. As soon as the optical sensor 14 detects that no further pills 11 have passed down the slide 10 within a preset time interval 220, the paddle shaped wedge 15 is rotated back to the first position and rotation of the bowl 1 is stopped 240.

Algorithms can contain a number of shakes x, a number of rotations y, a speed of rotation z, and a specified time interval w for which the micro-computer 19 waits until it is determined that all pills 11 have been removed from the bowl 1. The algorithms are adaptive and adaptation is based on a number of collection characteristics including the interval time w between pills 11 passing the sensors 14. For example, if pills 11 are passing too quickly to be accurately counted, the number of shakes x can be automatically increased, the speed of rotation z altered or both. Alternatively, if the interval w between pills is too long, the number of shakes x can be reduced, the speed of rotation z altered or both.

Preferably, the speed of rotation z of the bowl 1 is programmed in each algorithm to slow as the count approaches the required number preset by the user. Slowing of the speed of rotation z acts to slow the presentation of pills 11 to the slide 10 to increase the accuracy of the count and ensure that the wedge-shaped paddle 15 is rotated when the preset number of pills has been counted.

A number of preset or preprogrammed algorithms can be stored to cover a wide range of collection characteristics including pill types, sizes and shapes. The micro-computer 19 can therefore adjust from one algorithm to another in response to sensor 14 input. Alternatively, the user may alter particular parameters, such as the number of shakes x, based on historical data for a particular type of pill or to adapt an existing algorithm for a new pill type.

Applicant has found that small, smooth ball shaped pills 11 typically spin against the stationary spiral guide ramp 4 and do not readily exit the bowl 1. Varying the speed of the bowl rotation z and changing the frequency x and duration of the shaking maintains a more or less a constant frequency of pills 11 exiting the bowl 1. The frequency of exit can be determined by the presentation of the pills 11 at the optical sensor.

The embodiments of the invention in which an exclusive property or privilege is claimed are defined as follows:

1. Apparatus for counting objects comprising:

a bowl adapted for holding a plurality of the objects therein and rotatable about an axis in a housing, the bowl further comprising, a first annular inclined surface portion adjacent a bottom of the bowl, a second annular inclined surface portion adjacent a top of the bowl, and an annular, substantially flat ledge intermediate and interconnecting the first and second inclined surfaces;

a spiral guide ramp held stationary within the rotating bowl for guiding the objects from the bottom of the bowl to the ledge and from the ledge to the top of the bowl, the ramp forming a gap adjacent the ledge;

means for periodically altering an angular velocity of the rotation of the bowl so as to cause the objects on the ledge to either distribute individually therealong and traverse the gap to be guided to the top of the bowl or to fall through the gap to return to the bottom of the bowl;

a slide for guiding the objects individually from the top of the bowl to one of either a first collecting means or a second collecting means;

a counter for counting individual objects guided to the first collecting means; and a gate at a first position for guiding individual objects into the first collecting means and when a predetermined number of objects have been collected in the first collecting means the gate being actuable to a second position for guiding individual objects into the second collecting means.

2. The apparatus as described in claim 1 wherein the means for altering the angular velocity of the rotation of the bowl comprises a controller.

3. The apparatus as described in claim 2 wherein the controller alters at least one of a plurality of variables comprising a speed of rotation, a direction of rotation and a number of rotations in a first direction.

4. The apparatus as described in claim 2 wherein the controller alters the angular velocity of the rotation of the bowl by rotating in a first direction, performing a partial rotation in a reverse direction and resuming rotation in the first direction.

5. The apparatus as described in claim 4 wherein the controller further alters at least one of a speed of rotation and a number of rotations in the first direction.

6. The apparatus as described in claim 3 wherein the controller stores one or more algorithms each of which implement an alteration of at least one of the plurality of variables.

7. The apparatus as described in claim 6 wherein the counter determines collection characteristics of the object.

8. The apparatus as described in claim 7 wherein the controller selects one of the plurality of algorithms stored therein in response to the collection characteristics of the objects.

9. The apparatus as described in claim 7 wherein the collection characteristics of the object comprise at least a rate of presentation of the objects at the counter.

10. The apparatus as described in claim 7 wherein the counter further comprises a height-discriminating sensor for determining collection characteristics of the object.

11. The apparatus as described in claim 10 wherein the height-discriminating sensor is a plurality of vertically-stacked optical sensors.

12. The apparatus as described in claim 11 wherein the collection characteristics are a size or a shape of the objects.

13. The apparatus as described in claim 11 wherein the controller selects one of a plurality of algorithms stored therein in response to a size and the shape of the object.

14. The apparatus as described in claim 1 wherein the spiral guide ramp further comprises a flare extending from at least a portion of a lower edge of the ramp to assist in guiding the objects therealong.

15. The apparatus as described in claim 1 wherein the objects are pharmaceuticals.

16. The apparatus as described in claim 1 wherein the counter is a photo-emitter and a corresponding detector.

17. Apparatus for counting objects comprising:

a bowl adapted for holding a plurality of the objects therein and rotatable about an axis in a housing, the bowl further comprising, a first annular inclined surface portion adjacent a bottom of the bowl, a second annular inclined surface portion adjacent a top of the bowl, and an annular, substantially flat ledge intermediate and interconnecting the first and second inclined surfaces;

a slide for guiding the objects individually from the top of the bowl to one of either a first collecting means or a second collecting means;

a counter positioned at a bottom of the slide for counting the objects as the individual objects are guided to the first collecting means;

a gate at a first position for guiding individual objects into the first collecting means and when a predetermined number of objects have been collected in the first collecting means the gate being actuable to a second position for guiding individual objects into the second collecting means; and a spiral guide ramp held stationary within the rotating bowl for guiding the objects from the bottom of the bowl to the ledge and from the ledge to the top of the bowl, and having a flare extending from at least a portion of a lower edge of the spiral guide ramp to assist in guiding the objects therealong.

18. The apparatus as described in claim 17 further comprising means for periodically altering an angular velocity of the rotation of the bowl so as to cause the objects on the ledge to distribute individually therealong and traverse the gap to be guided to the top of the bowl or to fall through a gap in the spiral guide ramp to return to the bottom of the bowl.

19. The apparatus as described in claim 18 wherein the spiral guide ramp further comprises;

an inner spiral, an outer spiral and the gap being formed therebetween; and a downwardly depending flare formed at an end of the inner spiral for aiding in directing objects which are not distributed individually on the annular substantially flat surface portion through the gap and into the bottom of the bowl.

20. The apparatus as described in claim 18 wherein the spiral guide ramp further comprises;

an inner spiral, an outer spiral and the gap being formed therebetween; and a downwardly depending flare formed at a beginning of the outer spiral for aiding in maintaining objects which are distributed individually on the annular substantially flat surface portion.

21. A method of counting objects adapted for use with a spiral guide ramp held stationary in a bowl, the method comprising:

placing the objects in a bottom of the bowl, rotating the bowl so as to cause the objects to be guided along the stationary spiral guide ramp on a first annular inclined surface portion from a bottom of the bowl to an annular, substantially flat ledge and for guiding the objects from the ledge to the top of the bowl; and periodically altering an angular velocity of the rotation of the bowl so as to distribute objects on the ledge individually therealong and traverse a gap in the ramp adjacent the ledge to be guided to the top of the bowl or to fall through the gap to return to the bottom of the bowl.

22. The method as described in claim 21 further comprising altering at least one of a plurality of variables comprising a speed of rotation, a direction of rotation and a number of rotations in a first direction.

23. The method as described in claim 22 further comprising altering the angular velocity of the rotation of the bowl by rotating in a first direction, performing a partial rotation in a reverse direction and resuming rotation in the first direction.

24. The method as described in claim 22 further comprising altering the angular velocity in response to a collection characteristic of the object.

25. Apparatus for counting objects comprising:

a bowl adapted for holding a plurality of the objects therein and rotatable about an axis in a housing, the bowl further comprising, a first annular inclined surface portion adjacent a bottom of the bowl, a second annular inclined surface portion adjacent a top of the bowl, and an annular, substantially flat ledge intermediate and interconnecting the first and second inclined surfaces;

a spiral guide ramp held stationary within the rotating bowl for guiding the objects from the bottom of the bowl to the ledge and from the ledge to the top of the bowl, the ramp forming a gap adjacent the ledge;

a controller for periodically altering an angular velocity of the rotation of the bowl so as to cause the objects on the ledge to either distribute individually therealong and traverse the gap to be guided to the top of the bowl or to fall through the gap to return to the bottom of the bowl;

a slide for guiding the objects individually from the top of the bowl to one of either a first collecting means or a second collecting means;

a counter for counting individual objects guided to the first collecting means; and a gate at a first position for guiding individual objects into the first collecting means and when a predetermined number of objects have been collected in the first collecting means the gate being actuable to a second position for guiding individual objects into the second collecting means.

26. The apparatus as described in claim 25 wherein the controller alters at least one of a plurality of variables comprising a speed of rotation, a direction of rotation and a number of rotations in a first direction.

27. The apparatus as described in claim 26 wherein the controller alters the angular velocity of the rotation of the bowl by rotating in a first direction, performing a partial rotation in a reverse direction; and resuming rotation in the first direction.

28. The apparatus as described in claim 26 further comprising a plurality of algorithms stored in the controller, each of the plurality of algorithms comprising an alteration of at least one of the plurality of variables.

29. The apparatus as described in claim 28 wherein the counter determines collection characteristics of the object.

30. The apparatus as described in claim 29 wherein the controller selects one of the plurality of algorithms stored therein in response to a collection characteristic of the object.

31. The apparatus as described in claim 30 wherein the collection characteristic of the object is at least a rate of presentation of the object at the counter.

32. The apparatus as described in claim 29 wherein the counter further comprises a height-discriminating sensor.

33. The apparatus as described in claim 32 wherein the height-discriminating sensor is a plurality of vertically-stacked sensors.

34. The apparatus as described in claim 33 wherein the controller is capable of determining a shape of the objects from the collection characteristic of the object.

35. The apparatus as described in claim 33 wherein the controller selects one of a plurality of algorithms stored therein as a result of a shape of the object.

36. The apparatus as described in claim 25 wherein the controller is a micro-computer.

* * * * *